US006056836A

United States Patent [19]

Hoffman et al.

[11] Patent Number: 6,056,836

[45] Date of Patent: May 2, 2000

[54] ALMG ALLOY FOR WELDED CONSTRUCTIONS HAVING IMPROVED MECHANICAL CHARACTERISTICS

[75] Inventors: Jean-Luc Hoffman, Moirans; Guy-Michel Raynaud, Issoire; Martin-Peter Schmidt, La Murette; Herve Ribes, Les Pradets, all of France

[73] Assignee: Pechiney Rhenalu, Courbevoie, France

[21] Appl. No.: 09/027,569

[22] Filed: Feb. 23, 1998

Related U.S. Application Data

[63] Continuation-in-part of application No. 08/729,838, Oct. 15, 1996, abandoned.

[30] Foreign Application Priority Data

Oct. 18, 1995 [FR] France ..... 95 12466

[51] Int. Cl.[7] ..... C22C 21/00

[52] U.S. Cl. ..... 148/437; 148/438; 148/439; 148/688; 148/695; 420/528; 420/529; 420/531; 420/532; 420/534; 420/535

[58] Field of Search ..... 148/437, 438, 148/439, 688, 695; 420/528, 529, 531, 532, 534, 535

[56] References Cited

U.S. PATENT DOCUMENTS 4,043,840 8/1977 Sperry et al. ..... 148/32

5,523,050 6/1996 Lloyd et al. ..... 420/528

OTHER PUBLICATIONS

"Contribution to the Study of the Rate of Fatigue Cracking of the Aluminum Alloy 5083 at Low Temperature", R. Deschamps, Metaux Corrosion–Industrie, vol. 21, Jul.–Aug.1976, pp. 278–291 (with English language Abstract).

*Primary Examiner*—Patrick Ryan
*Assistant Examiner*—M. Alexandra Elve
*Attorney, Agent, or Firm*—Dennison, Meserole, Scheiner & Schultz

[57] ABSTRACT

Sheet for welded constructions having an ultimate tensile strength $R_m$>275 MPa, elongation A>22% and a product $A \times R_m$>7000, having the composition, in % by weight:

| | | |
|---|---|---|
| Mg: 4.2–4.7; | Mn: 0.20–0.40; | Zn: <0.20; |
| Fe: 0.20–0.45; | Si <0.25; | Cr <0.15; |
| Cu <0.25; | Ti <0.10; | Zr <0.10; |

other elements <0.05 each and <0.20 in total, balance Al.

9 Claims, No Drawings

ALMG ALLOY FOR WELDED CONSTRUCTIONS HAVING IMPROVED MECHANICAL CHARACTERISTICS

This application is a continuation-in-part of U.S. application Ser. No. 08/729,838 filed Oct. 15, 1996, now abandon.

BACKGROUND OF THE INVENTION

1. Field of the Invention

The invention relates to the technical field of sheets of aluminum alloy of the AlMg type and, more particularly, of 5083 or 5086 alloy according to the standard EN 573-3, intended for welded constructions such as stationary or movable tanks and, in particular, road or railway tankers for solid or liquid substances.

2. Description of Related Art

To increase the mechanical strength of welded constructions while reducing their weight, it is desirable to utilize alloys having better mechanical characteristics than the 5083 or 5086 alloys currently used without adversely affecting the other properties for use such as weldability, resistance to corrosion and formability.

The two mechanical characteristics which, according to the principles of mechanical construction familiar to a skilled person, should be optimized to ensure suitable plastic behavior of the aluminum alloy structures are the elongation at break A and the ultimate tensile strength $R_m$. In the case of AlMg alloys, these two characteristics tend to evolve in opposite directions if the composition of the alloy is modified and a compromise has to be found for each type of application. This is why, to calculate the behavior of the structures under rapid plastic deformation, for example in the event of an accident, the product $A \times R_m$ is generally used for these alloys, since A and $R_m$ each have suitable minimum values.

The object of the present invention is therefore to improve this compromise between the elongation and the tensile strength while ensuring satisfactory corrosion resistance and a production program which is as simple and reliable as possible.

Japanese patent application JP 06-212373 gives examples of sheets of AlMgMn alloy exhibiting a good compromise between the elongation and the strength, but production by hot-rolling necessitates a minimum delivery temperature from the rolling mill of 450° C., demanding a rapid production rate and minimum lubrication and not allowing reliable and economic production of strips.

Japanese patent application JP 06-93365 also provides sheets of AlMgMn alloy having mechanical characteristics satisfying the object set, but the production thereof involves a complicated, expensive program including hot-rolling followed by intermediate annealing, warm rolling and final annealing.

SUMMARY OF THE INVENTION

Applicants have demonstrated a narrow spread of compositions within ranges of compositions of the 5083 and 5086 alloys allowing the objects set to be achieved with regard to the mechanical characteristics and allowing a reliable, economic production program to be employed.

The sheets for welded constructions according to the invention are produced from AlMg alloy having the following composition (% by weight):

Mg:4.2–4.7; Mn:0.2–0.4;

Fe:0.2–0.45; Si<0.25; Cr:<0.15;

Cu<0.25; Ti<0.10; Zr<0.10;

other elements: <0.05 each and <0.20 total;

balance Al, and an ultimate tensile strength $R_m$>275 MPa, elongation A>22% and product $R_m \times A$>7000 ($R_m$ expressed in MPa and A in %).

The sheets according to the invention are preferably produced without final annealing and by hot-rolling with a delivery temperature from the rolling mill of between 300 and 370° C. and preferably between 320 and 360° C.

DETAILED DESCRIPTION OF THE INVENTION

The role of magnesium and manganese as alloying elements is well known. Magnesium ensures high mechanical strength but an excessive content reduces the corrosion resistance which would limit use of tanks produced from such alloys.

Manganese improves the tensile strength but an excessive content reduces the elongation. It is also known that zinc improves the tensile strength in the presence of manganese but Applicants have surprisingly found that, for the selected magnesium and manganese contents, the product $A \times R_m$ depends on the sum Mn+Zn rather than on the individual contents of Mn and Zn and that this product was clearly improved if the sum Mn+Zn was lower than 0.6%.

In the spread of compositions used for Mg, Mn and Zn, an addition of chromium, providing it does not exceed 0.15%, allows both the elongation A and the corrosion resistance to be improved, and an addition of copper lower than 0.15% increases $R_m$.

The iron content should be below 0.45% to avoid the formation of primary phases whose presence causes unacceptable deterioration of the mechanical characteristics of the sheet. However, in the spread of compositions used for the elements Mg, Mn and Zn, Applicants have surprisingly found that it is advantageous to select an iron content close to 0.45% because almost all the iron forms eutectic precipitates of the AlMnFe type during casting. To have high ductility, the fraction of manganese dispersoids in the final sheet should remain low, preferably below 1.5 times the fraction of eutectics.

The volumetric fractions of eutectic precipitates and of dispersoids are measured by the surface fractions calculated on micrographs by well known methods of metallography, for example by scanning electron microscopy and analysis of images over a polished section of a sample of sheet.

This possibility of selecting an iron content which is not too low allows a basic metal which is less pure and is therefore less expensive allowing having good mechanical characteristics to be selected.

With the composition according to the invention it is possible to obtain sheets having a thickness >2 mm and ultimate tensile strength $R_m$>275 MPa, elongation A>22% and a product A×$R_m$>7000, by rolling without final annealing at a temperature >250° C. and, more particularly, by hot-rolling and in a large width, for example >2200 mm. For reasons of industrial reliability, it is preferable for the delivery temperature from the hot-rolling mill to be lower than 400° C. and preferably lower than 370° C., even 350° C.

The sheets according to the invention can be used for welded constructions such as stationary or movable tanks, for example rail or road tankers, but also for road, rail and/or maritime transport containers as well as for welded and/or forged wheels for cars or trucks. These sheets can be welded by any methods normally used for this type of alloy, in particular by butt welding by an MIG or TIG process and with a bevel of the order of 45° over about ⅔ of the thickness. It is advantageous for all these applications to have sheets with a large width, in particular with a width greater than 2200 mm.

It is particularly worthwhile having sheets with improved mechanical characteristics in the case of road tankers intended for transporting dangerous substances, which must have suitable plastic behavior in the event of an accident.

EXAMPLES

Eight alloys having the compositions indicated in table 1 were produced by semi-continuous casting of plates. After heating for 20 h at a temperature higher than 500° C., the plates were hot-rolled to a final thickness of 6 mm. The rolling-mill delivery temperature was 340° C.

Alloy 1 has a composition outside the invention, representing a 5083 composition, and alloys 2 to 9 have a composition according to the invention.

The ultimate tensile strength $R_m$ and the elongation A were measured on these sheets. The surface fractions of eutectic precipitates and dispersoids were measured on micrographs produced by optical microscopy. These results are compiled in Table 1 and show that invariably $R_m$>275 MPa, A>22%, and even >24%, and the product A×$R_m$>7000 with the compositions according to the invention.

MIG welding tests produced by MIG butt welding with a bevel of 45° over ⅔ of the thickness have shown weldability similar to that of sheets of 5083 and 5086 alloys of normal composition.

TABLE 1

| Ref. | Mg % | Cu % | Mn % | Fe % | Si % | Cr % | Zn % | Eutectic Fraction EF | Dispersoid Fraction DF | DF/EF | $R_m$ MPa | A % | $R_m$xA |
|---|---|---|---|---|---|---|---|---|---|---|---|---|---|
| 1 | 4.52 | 0.01 | 0.72 | 0.12 | 0.16 | 0.05 | 0.01 | 0.63 | 1.10 | 1.7 | 296 | 17 | 5032 |
| 2 | 4.50 | 0.02 | 0.31 | 0.45 | 0.20 | 0.03 | 0.08 | 0.85 | 0.31 | 0.36 | 277 | 27 | 7479 |
| 3 | 4.31 | 0.18 | 0.40 | 0.37 | 0.22 | 0.03 | 0.12 | 0.89 | 0.52 | 0.58 | 285 | 25 | 7125 |
| 4 | 4.37 | 0.06 | 0.32 | 0.29 | 0.14 | 0.07 | 0.05 | 0.62 | 0.27 | 0.43 | 290 | 24.2 | 7018 |
| 5 | 4.46 | 0.06 | 0.33 | 0.30 | 0.15 | 0.07 | 0.05 | 0.65 | 0.30 | 0.46 | 292 | 25.8 | 7533 |
| 6 | 4.39 | 0.06 | 0.32 | 0.29 | 0.14 | 0.07 | 0.04 | 0.62 | 0.27 | 0.43 | 289 | 24.7 | 7138 |
| 7 | 4.42 | 0.07 | 0.28 | 0.25 | 0.12 | 0.03 | 0.07 | 0.51 | 0.17 | 0.34 | 288 | 27.8 | 8006 |
| 8 | 4.47 | 0.06 | 0.25 | 0.23 | 0.13 | 0.02 | 0.06 | 0.44 | 0.14 | 0.32 | 278 | 28.3 | 7867 |
| 9 | 4.31 | 0.05 | 0.32 | 0.27 | 0.13 | 0.07 | 0.04 | 0.58 | 0.25 | 0.43 | 293 | 26.9 | 7881 |

What is claimed is:

1. Sheet for welded constructions having an ultimate tensile strength $R_m$>275 MPa, elongation A>22% and a product A×$R_m$>7000, having the composition, consisting essentially of in % by weight:

| | | |
|---|---|---|
| Mg: 4.2–4.7; | Mn: 0.20–0.40; | Zn: <0.20; |
| Fe: 0.20–0.45; | Si <0.25; | Cr <0.15; |
| Cu <0.25; | Ti <0.10; | Zr <0.10; |

other elements <0.05 each and <0.20 in total, balance Al.

2. Sheet according to claim 1, having disperoids and eutectics in a proportion such that the volumetric fraction of dispersoids is less than 1.5 times the fraction of the eutectics.

3. Sheet according to claim 1, produced without final annealing.

4. Sheet according to claim 3, produced by hot-rolling with a rolling mill delivery temperature of between 300 and 370° C.

5. Sheet according to claim 4, wherein the hot rolling mill delivery temperature is between 320 and 360° C.

6. Sheet according to claim 4, having a width greater than 2200 mm.

7. Sheet according to claim 5, having a width greater than 2200 mm.

8. A stationary or movable tank comprising at least one sheet for welded construction having an ultimate tensile strength $R_m$>275 MPa, elongation A>22% and a product A×$R_m$>7000, said at least one sheet having the composition, consisting essentially of in % by weight:

| | | |
|---|---|---|
| Mg: 4.2–4.7; | Mn: 0.20–0.40; | Zn: <0.20; |
| Fe: 0.20–0.45; | Si <0.25; | Cr <0.15; |
| Cu <0.25; | Ti <0.10; | Zr <0.10; |

other elements <0.05 each and <0.20 in total, balance Al.

9. A tank according to claim 8, which is a road or railway tanker.

* * * * *